United States Patent [19]

Buchan et al.

[11] 4,406,244

[45] Sep. 27, 1983

[54] LAUNCHING AND RECOVERY APPARATUS

[76] Inventors: Alexander B. Buchan, 61, Warsash Rd., Warsash, Hants.; Andrew R. Kingswood, 12 Penhurst Rd., Bedhampton, Hants., both of England

[21] Appl. No.: 269,362

[22] Filed: Jun. 1, 1981

[51] Int. Cl.[3] ..... B63B 23/02

[52] U.S. Cl. ..... 114/368

[58] Field of Search ..... 114/365-378, 114/51

[56] References Cited

U.S. PATENT DOCUMENTS 2,761,571 9/1956 Adams ..... 114/366

FOREIGN PATENT DOCUMENTS 14647 of 1912 United Kingdom ..... 114/373

23176 of 1914 United Kingdom ..... 114/365

*Primary Examiner*—Trygve M. Blix

*Assistant Examiner*—Jesús D. Sotelo

*Attorney, Agent, or Firm*—Duckworth, Allen, Dyer & Pettis

[57] ABSTRACT

A launching and recovery apparatus for a lifeboat, rescue launch or like small boat fitted to a ship, floating or fixed marine platform or other vessel which is controlled by a single fall comprises a launching and recovery cradle 7 from which a boat can hang freely on a releaseable support. During its travel between a fully hoisted and a partly lowered position the boat and cradle are supported on trackways 2 extending inwardly and upwardly from the deck of the vessel by roller assemblies 31, 32 at the base of the cradle which run on respective trackways. The cradle 7 has a symmetrical upwardly convergent frame 35, 36, 37 whose apex is arranged for connection of the single fall wire 43 by which the cradle is held in a stable attitude during launching and recovery with the boat suspended freely from the cradle on a single releaseable support 38. A single sheave 15 located above the cradle symmetrically between the trackways **2*a* takes up or pays out the fall wire 43, to raise or lower the cradle 7.** The boat is suspended from a position well above its center of gravity which assists stability in roll and pitch and the arrangement is of simplified construction and uses less moving parts than previous designs of cradle launched boats.

8 Claims, 6 Drawing Figures

LAUNCHING AND RECOVERY APPARATUS

The present invention relates to a launching and recovery apparatus for ship's life boats, rescue launches for oil rigs or drilling platforms and the like vessels.

Broadly stated the invention provides a launching and recovery apparatus for a lifeboat, rescue launch or like small boat fitted to a ship, floating or fixed marine platform or other vessel comprising a launching and recovery cradle having an upwardly convergent symmetrical frame whose apex is arranged for connection thereto of a single fall wire and a releaseable boat support so that the boat can hang from the cradle during launching and recovery while the cradle is held in a stable attitude by the fall; first and second trackways extending inwardly and upwardly from the deck of the vessel for supporting and guiding the boat and cradle during its travel between a fully hoisted position and a partly lowered position; first and second roller assemblies at opposite ends of the base of the cradle which during travel of the boat and cradle between the fully hoisted position and the partly lowered position run on respective trackways and means including a sheave located above the cradle symmetrically between the trackways for taking up or paying out the fall wire to effect raising or lowering of the cradle.

The present apparatus enables boats to be recovered at high pendulum angles owing to the centrally positioned fall wire. Angles of up to 8 degrees which are much higher than is possible with more normal twin full installations may be used. The boat is attached to its cradle at a point which is relatively high above the center of gravity of the boat so that the boat is stable in roll when in the raised position, and there is also acceptable stability in pitch. Only a single release mechanism is necessary for launching the boat, and recovery of the boat is simplified because only one wire has to be attached to secure the boat to the cradle. The fact that the boat and cradle are held against the ship's side and/or the trackways during launch, recovery and stowage make it possible for a minimum of manpower to be required to safely achieve the operation.

In a preferred embodiment a rigid frame member extends over the boat from one side to the other at a longitudinal position coinciding with the center of gravity of the boat and is securely attached thereto and the boat is secured to the cradle by a boat support strop having at its lower end a releaseable attachment slideable on the frame member and having its upper end fixed to the apex of the frame. The use of a rigid frame member has advantages where there is provided release gear which is operated by the inherent buoyancy of the boat so that if a ship or marine platform on which the boat is carried sinks the boat is automatically released allowing the boat to float free and to be available for rescue purposes. Our U.K. Patent Application No. 2029844 describes release gear for a cradle launched lifeboat comprising a hook or cradle engageable by suspension means supporting the lifeboat in the stowed position, the open end of the hook being closed by closure means including a frangible element designed to break and release the suspension means from the hook when the lifeboat moves upwardly relative to the cradle due to its inherent buoyancy. If the rigid frame member is engaged with the hook to act as the suspension means then it is positively disengaged from the hook in the event of the ship or platform sinking.

An embodiment of the invention will now be described, by way of example only, with reference to the accompanying drawings, in which.

Figure 1:
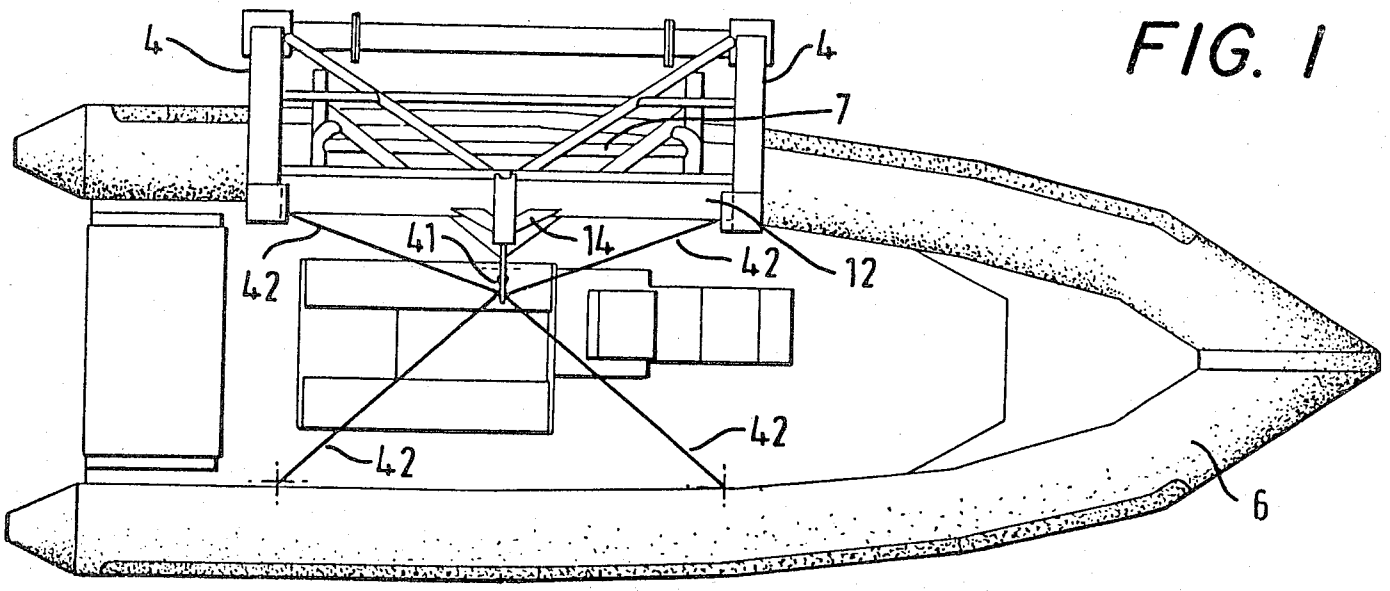
FIG. 1 is a plan view of a first embodiment of the boat launching and recovery installation.
Figure 2:
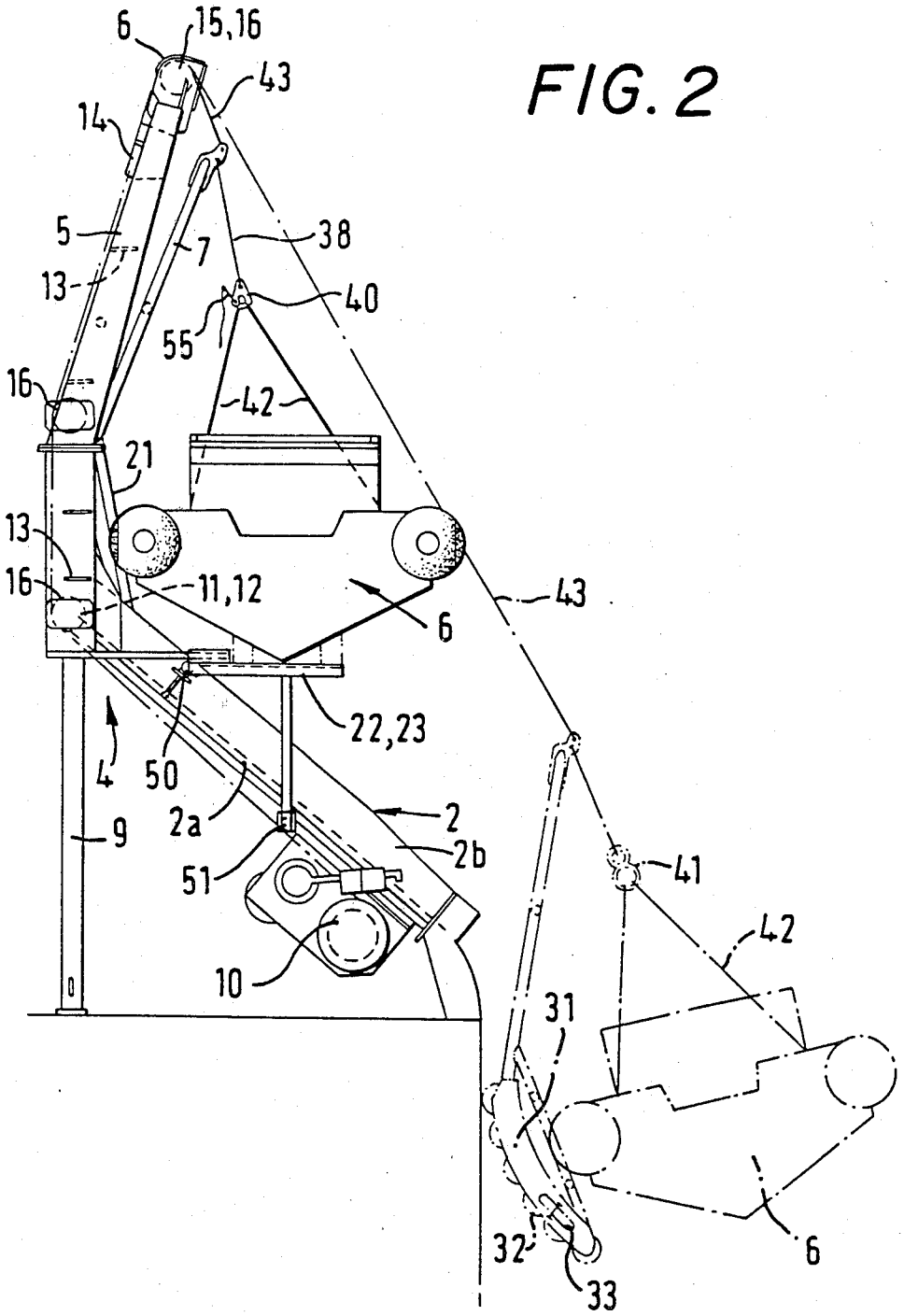
FIG. 2 is a front elevation of the boat launching and recovery installation with a boat and launching cradle in the stowed position denoted by the solid lines and in the launching/recovery position by the chain dotted lines.
Figure 3:
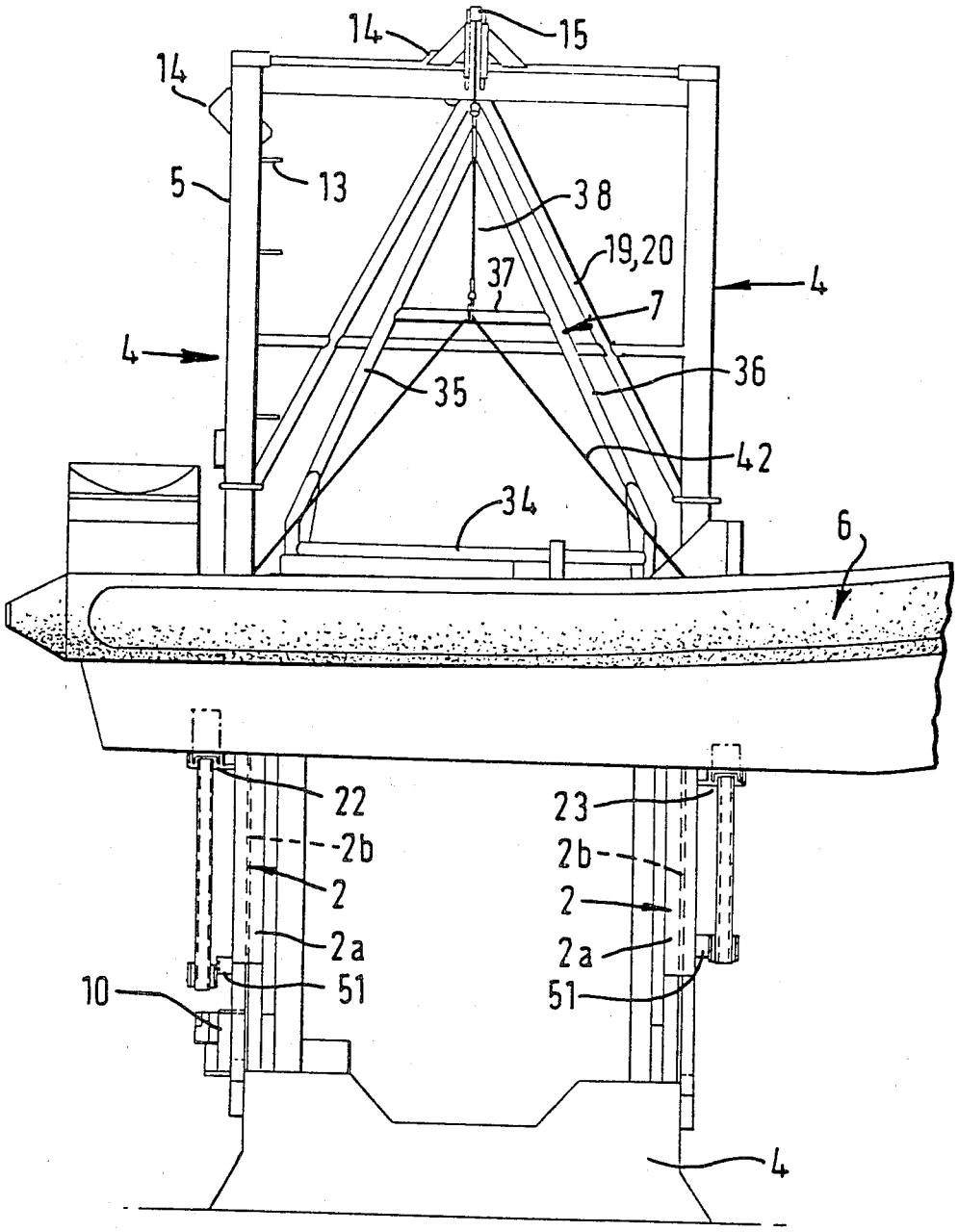
FIG. 3 is a side view of the boat launching and recovery installation.

The installation shown in FIGS. 1 to 3 includes a pair of davit members 4 secured to a ship, marine platform or other vessel from which a launching and recovery cradle 7 carrying rescue or survival craft, here a twin-pontoon semi-rigid rescue boat 6, can be raised or lowered. It is a modification of the boat launching and recovery technique described in Research Disclosure No. 15142 dated November, 1976. The craft 6 is stowed in a raised position for embarkation in its cradle which is provided with rollers 32 which run on an inclined track forming part of the davit members 4. The cradle protects the craft during launch and the provision of a trackway eliminates the need to provide a davit which rotates from an inboard to an outboard position. In launching the cradle 7 rolls down the trackway provided in the davit members 4 and continues down the side of the vessel until it is submerged and the craft 6 is floating in the water. For recovery, the rescue craft is attached to suspension wires depending from the cradle by means of snap hooks and the cradle 7 carrying the craft 6 can be winched back on board.

A system generally similar to that described above has been sold under the Trade name MIRANDA and has the advantages that the survival craft can be launched from a vessel with a list of up to 30° in either direction and at an angle of fore and aft trim of up to 15°. The survival craft can be launched or recovered from a vessel which is under way at speeds up to 8 knots. The davit members 4 are fixed and have no moving parts other than the sheaves at their upper ends. Embarkation is from the fully stowed position of the survival or rescue craft and launch and recovery is both safe and speedy.

The conventional Miranda cradle is arranged to be launched from a pair of davits and the cradle superstructure has a pair of pillars each in approximate alignment with a respective davit. A pair of fall wires passes over sheaves at the top ends of the davits and one of the fall wires is connected to the top of each pillar.

We have now found that the cradle can be hoisted or lowered by means of a single fall wire, that the boat can hang freely in the cradle from a single suspension wire and that launching and recovery of the craft 6 can be carried out with this single point suspension arrangement in place of the more traditional two point suspension.

In FIG. 2 it may be seen that each davit member generally indicated by reference numeral 4 including a lower portion 2 in which is formed a trackway which is radiused at its lowest extremity and extends inwardly and upwardly from the side of the vessel at an angle of about 45 degrees. An outwardly directed davit arm 5 is provided at the top end of the trackway 2, which is formed with an inclined surface 2*a* over which wheels 32 of the cradle 7 run and an upstanding wall 2*b*. The top ends of the two davit members 4 are interconnected by means of a cross-beam 14 to the mid-point of which is secured a sheave housing 16 within which is journalled a main sheave 15 over which a fall wire 43 runs to the cradle 7. The fall wire may be paid out to the main sheave from a winch 10 and runs over idler sheaves 16 secured in the davit framework. The davit assembly further comprises keel supports 22, 23 which intersect the lower track portions 2 to which they are secured by pivots 50, the supports 22, 23 being held in their boat supporting position by means of locking pins 51 and pivoting to a stowed positon below the tracks 2, when the locking pins are removed, prior to the boat being launched.

The cradle 7 includes a pair of curved roller support frames 31 provided with a multiplicity of rollers 32 pivoted for rotation about horizontal axes which lie on a curve whose center approximately coincides with the center of gravity of the combination of the cradle and boat. The rollers 32 are of equal diameter and run on the inclined surfaces 2*a*. The outer faces of the curved frames 31 carry respective guide wheels 33 pivoted about axes normal to the axes of the rollers 32 and which during raising or lowering of the cradle run on the inner faces of the walls 2*b* of the respective davit members 4 to provide fore and aft location of the boat and cradle relative to the davit members while the cradle is traversing said lower track portions. The curved roller support frames 31 at each end of the cradle are interconnected by a longitudinal member 34 and an upwardly convergent generally A-shaped framework constituted by side members 35 and 36 and a horizontal reinforcing bar 37. To the apex of the cradle is secured a launching strop 38 having at its lower end a quick release hook 40 which locates in a ring 41 which holds the upper end of four support wires 42 attached to the boat. By this means the boat can be supported level in the cradle with its side resting against the roller support frames 31 substantially as shown. The apex of the framework 7 is also provided with an attachment for the single fall wire 43 by means of which the cradle is raised and lowered.

For lowering a boat from the stowed position shown in FIG. 2 in solid lines to a launch position showed in dotted lines, the winch 10 is operated to take in the fall wire 43 so that the weight of the boat is supported, after which the locking pins 51 can be removed and the keel supports 22, 23 pivoted below the davit track portions 2. The winch 10 can then be operated to pay off the fall wire 43 until the cradle has moved to the lowered position, after which the quick release hook can be operated by pulling a lanyard 55 to free the boat from its cradle. The winch 10 is operated by gravity so that no power is required for lowering.

The boat may be recovered by bringing it alongside the cradle which is in its lowered position. A recovery strop is placed into the ring 41 and the fall wire 43 is paid out so that a major portion of the cradle sinks below the water level. The recovery strop is snapped onto the fall wire 43 and the winch is actuated to take up the fall wire. The snap hook slides down the fall wire until it rests on the cradle head, after which the boat is held in the correct position relative to the cradle. Further take up of the fall wire 43 lifts the boat and cradle together out of the water. However, the effect of current, tide and/or wind on the boat and cradle may be such that the fall wire 43 is directed at an angle (the pendulum angle) to the vertical, and the boat is not in the correct position relative to the davits. The arrangement is such, however, that as the boat is lifted, the pendulum angle reduces progressively because of the combined weight of the boat and cradle so that by the time that the rollers 32 have reached the foot of their respective davit tracks 2 the boat and cradle have been brought back into the correct longitudinal alignment. When the boat and cradle have reached a sufficient height, the keel supports 22, 23 are returned to their normal position and the boat is lowered onto them. The final step is to replace the recovery strop by the cradle head strop (i.e., the one used in the lowering operation) once the boat has been safely stowed.

Figure 4:
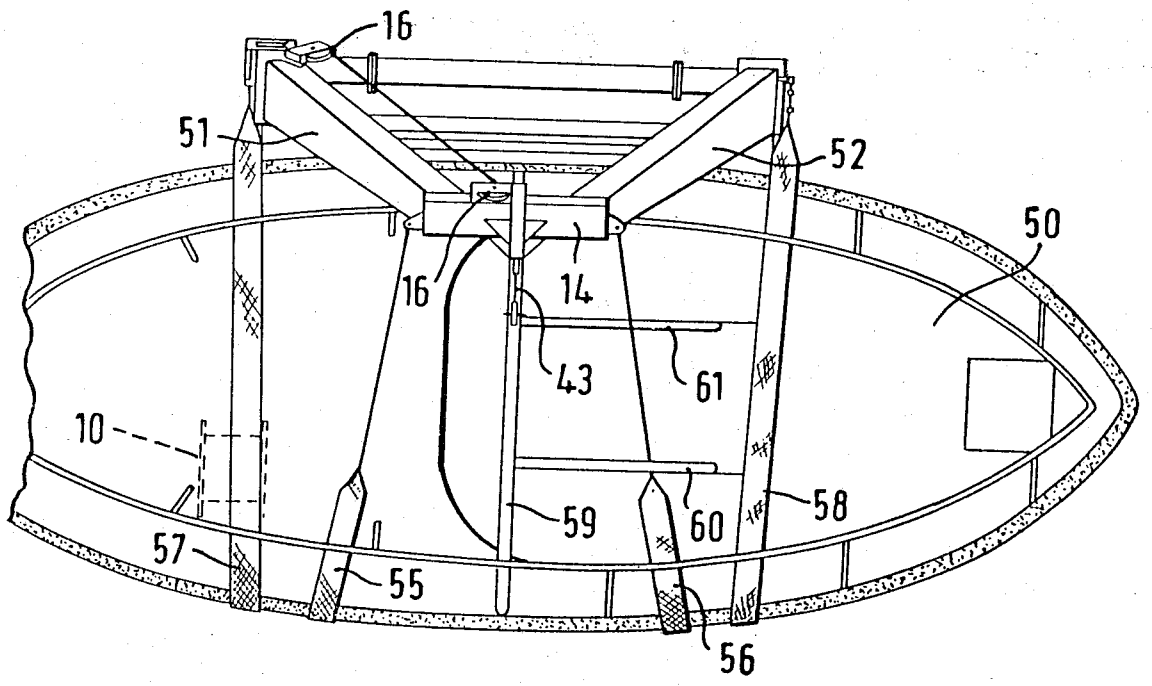
FIGS. 4, 5 and 6 are respectively a plan, rear elevation and side view of a second embodiment of the boat launching and recovery installation.
Figure 5:
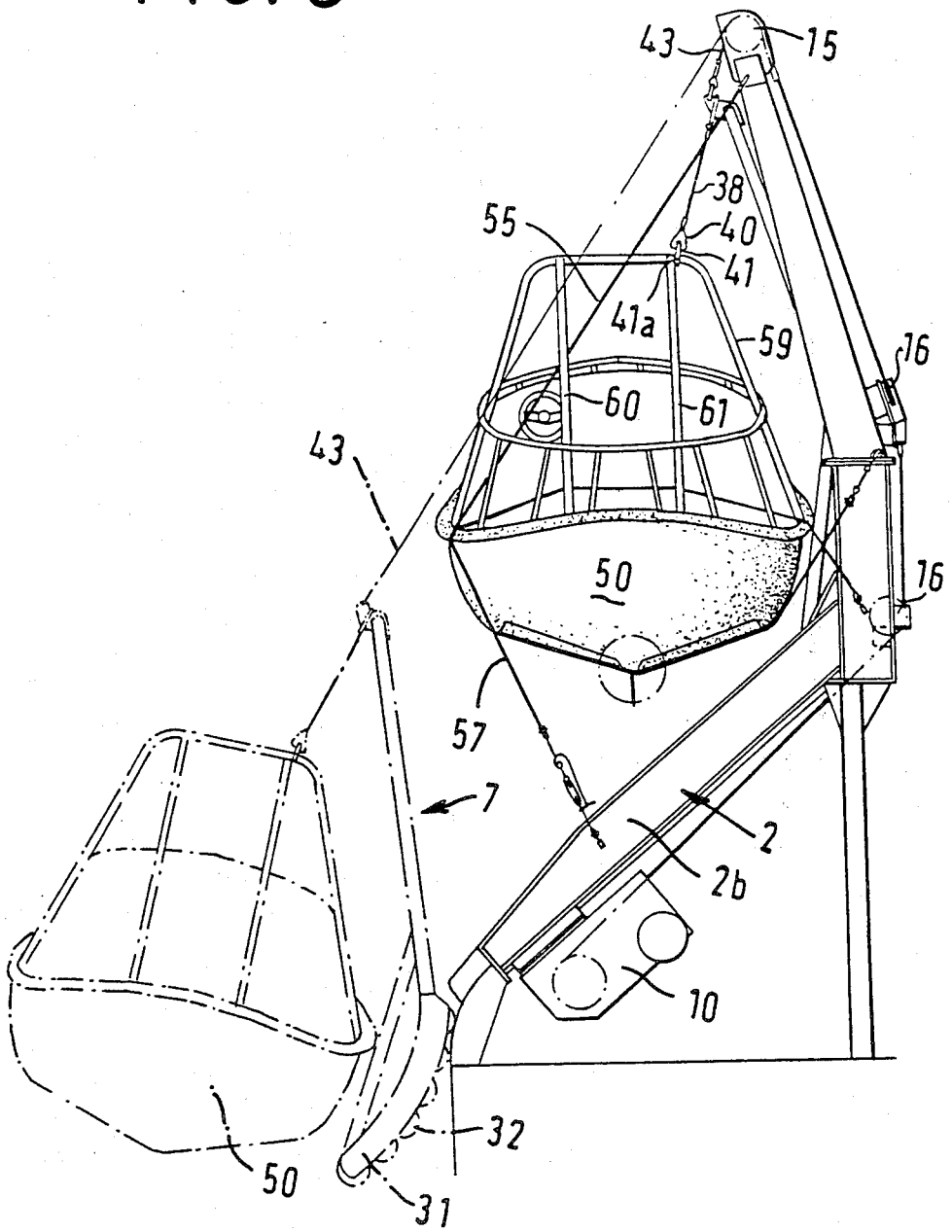
Figure 6:
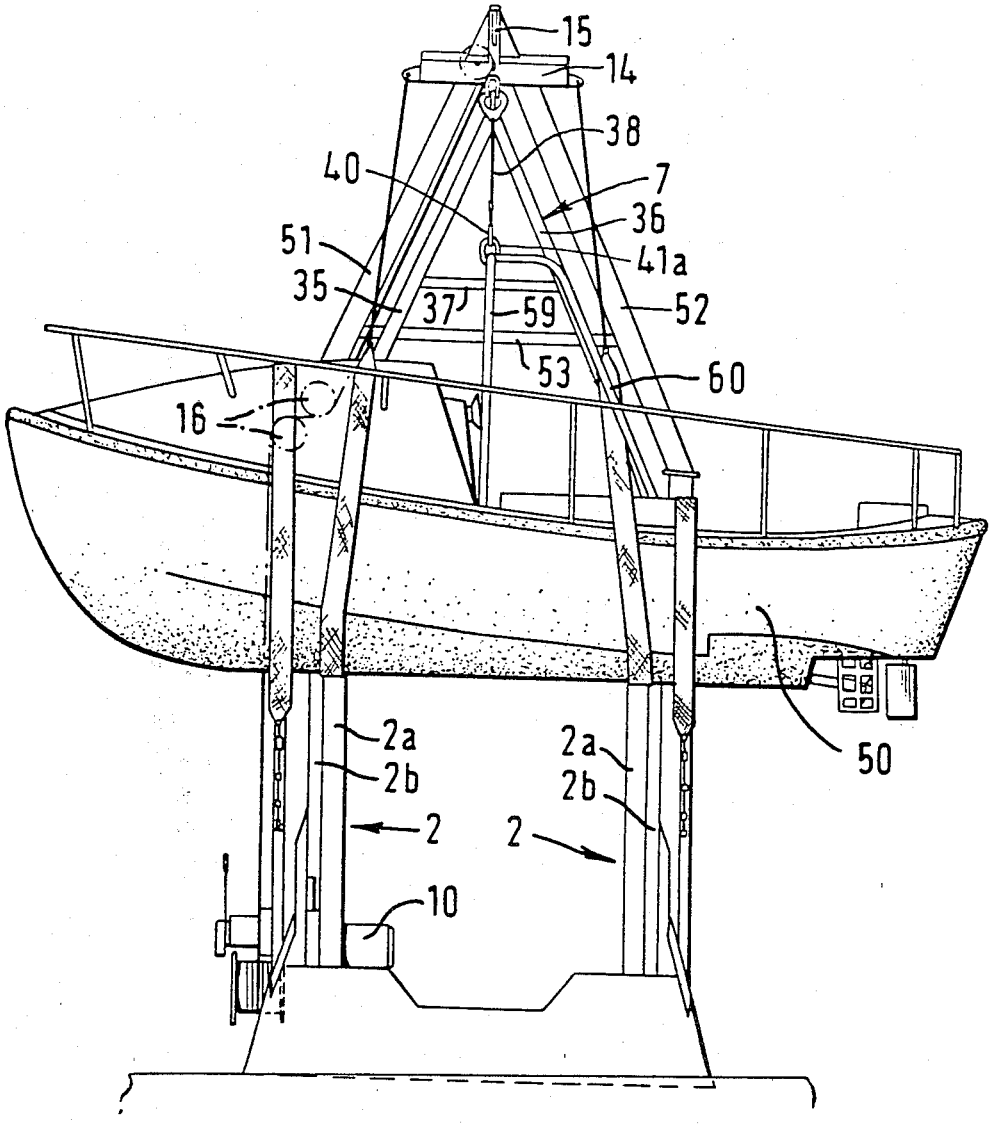

The embodiment shown in FIGS. 3 to 5 is generally similar to that described above except that the boat 50 in the cradle 7 is a rigid 6.5 m. pick-up of laden weight 2300 kg and carrying up to 9 people. The davit has lower tracked portions 2 as previously described but has a generally A-shaped superstructure defined by upwardly convergent frame members 51 and 52 and a cross-member 53 at whose apex the sheave housing 14 is supported. The boat 50 is stabilised in the stowed position against pitch of the vessel by means of four webbing straps, two of which 55, 56 pass underneath the vessel as support therefor and two of which 57, 58 pass over the vessel as gripe straps. The boat 50 has a lifting bar 59 of inverted U-shape secured transversely in longitudinal alignment with its center of gravity and rigidly stabilised in its inverted attitude by means of support bars 60, 61. The bar 59 carries a ring 41*a* to which may be attached the quick release hook 40 previously described.

Instead of having rigid support bars 60, 61 for the lift bar 59, the lift bar may be pivoted across the boat 50 and may be stabilized in its upright attitude for launching and stowage by means of wires. Instead of an open boat 50, the cradle 7 may carry a totally enclosed survival craft such as is required for use on oil drilling rigs and the like.

We claim:

1. A launcing and recovery apparatus for a lifeboat rescue launch fitted to a vessel, comprising:

a launching and recovery cradle having an upwardly convergent symmetrical frame, said frame having an apex, a single fall wire connected to said apex, and a releasable boat support so that the rescue launch can hang from said cradle during launching and recovery while said cradle is held in a stable attitude by said fall wire;

first and second trackways extending inwardly and upwardly from the deck of the vessel for supporting and guiding the rescue launch and said cradle during its travel between a fully hoisted position and a partly lowered position;

first and second roller assemblies at opposite ends of the base of said cradle which, during travel of the rescue launch and said cradle between the fully hoisted position and the partly lowered position, run on respective ones of said trackways; and means including a sheave located above said cradle symmetrically between said trackways for taking up or paying out said fall wire to affect raising or lowering of said cradle.

2. Apparatus according to claim 1, further comprising a boat support strop whose upper end is attached to the apex of said frame; and a plurality of boat suspension ropes releasably attached to the lower end of said boat support strop.

3. Apparatus according to claim 1, further comprising:

a rigid frame member extending over the rescue launch from one side to the other at a longitudinal position coinciding with the center of gravity of the rescue launch and is securely attached thereto; and wherein the rescue launch is secured to the cradle by a boat support strop having at its lower end a releaseable attachment slideable on said frame member and having its upper end fixed to the apex of the frame.

4. Apparatus according to claim 1, wherein the roller assemblies further comprise curvilinear members supporting a plurality of rollers with their axes disposed on a curve whose center substantially coincides with the center of gravity of the combined rescue launch and cradle.

5. Apparatus according to claim 4, wherein the outer faces of the curvilinear members additionally comprise guide wheels which engage respective davit trackways for fore and aft location of the cradle during its travel up or down the trackway.

6. Apparatus according to claims 1, 2, 3, 4 or 5 wherein the upwardly convergent part of the cradle is generally A-shaped.

7. Apparatus according to claims 1, 2, 3, 4 or 5 wherein the sheave for taking up or paying out the fall wire is supported on a generally A-shaped structure above the trackways.

8. Launching and recovery apparatus for a rescue craft, such as a lifeboat, rescue launch, small boat or the like, fitted to a vessel, such as a ship, floating marine platform or the like, comprising:

a surface extending upwardly from the waterline of such vessel to the deck thereof, said surface defined by the hull of such vessel;

first and second trackways spaced apart and parallel along said surface and extending inwardly and upwardly therefrom;

a davit structure extending outwardly and upwardly from an upper end of said trackways;

a sheave supported by said davit structure in a fixed location symmetrically between said trackways;

a single fall wire supported by said sheave, and taken up or paid out by said sheave;

a launching and recovery cradle having an upwardly convergent symmetrical frame, said frame having an apex connected to said single fall wire, whereby said cradle is raised or lowered as said single fall wire is taken up or paid out of said sheave, and roller assemblies connected to the base of said symmetrical frame, said roller assemblies disposed to permit said cradle to be supported on and guided by said trackways in its raised position and supported on said hull surface toward the lowered position of said cradle; and suspension means for suspending the rescue craft from a single suspension point at said apex of said cradle and having a single releasable attachment for maintaining said rescue craft in a stable level attitude in said cradle during raising and lowering thereof.

* * * * *